US008011354B2

(12) United States Patent
Fujiyama

(10) Patent No.: US 8,011,354 B2
(45) Date of Patent: Sep. 6, 2011

(54) IGNITION COIL FOR INTERNAL COMBUSTION ENGINE

(75) Inventor: Norihito Fujiyama, Obu (JP)

(73) Assignee: Denso Corporation, Kariya (JP)

( * ) Notice: Subject to any disclaimer, the term of this patent is extended or adjusted under 35 U.S.C. 154(b) by 354 days.

(21) Appl. No.: 12/427,191

(22) Filed: Apr. 21, 2009

(65) Prior Publication Data

US 2009/0260608 A1 Oct. 22, 2009

(30) Foreign Application Priority Data

Apr. 22, 2008 (JP) ..... 2008-111879
Mar. 24, 2009 (JP) ..... 2009-071600

(51) Int. Cl.
*H01F 38/12* (2006.01)
*H01F 38/00* (2006.01)

(52) U.S. Cl. ..... 123/634

(58) Field of Classification Search ..... 123/634, 123/635, 632, 621; 336/90, 198, 212, 178
See application file for complete search history.

(56) References Cited

U.S. PATENT DOCUMENTS 4,990,881 A * 2/1991 Ooyabu ..... 336/110
5,497,756 A * 3/1996 Matthiesen et al. ..... 123/634
5,685,065 A * 11/1997 Suzuki et al. ..... 29/606
7,209,023 B2 * 4/2007 Klocinski et al. ..... 336/90
2007/0096859 A1 5/2007 Groezinger et al.

FOREIGN PATENT DOCUMENTS

JP 6-084664 3/1994

* cited by examiner

*Primary Examiner* — Mahmoud Gimie
(74) *Attorney, Agent, or Firm* — Nixon & Vanderhye PC

(57) ABSTRACT

A housing of an ignition coil has an approximately rectangular shape. A central core is in parallel with both side surfaces of the housing. The peripheral core has a larger size than the central core in a direction of a height of the housing. A first and second side portions of the peripheral core are opposed to both axial end surfaces of the central core, respectively. A third and fourth side portions of the peripheral core interpose the central core, a primary coil and a secondary coil therebetween to magnetically connect the first side portion to the second side portion. A terminal treatment portion for electrically connecting the primary coil to an external electric power source is arranged above or below the first side portion of the peripheral core. The peripheral core is positioned off-center with respect to the central core in the direction of the height of the housing.

7 Claims, 6 Drawing Sheets

IGNITION COIL FOR INTERNAL COMBUSTION ENGINE

CROSS REFERENCE TO RELATED APPLICATION

This application is based on and incorporates herein by reference Japanese Patent Applications No. 2008-111879 filed on Apr. 22, 2008 and No. 2009-071600 filed on Mar. 24, 2009.

BACKGROUND OF THE INVENTION

1. Field of the Invention

The present invention relates to an ignition coil for an internal combustion engine, which applies high voltage to a spark plug in the internal combustion engine.

2. Description of Related Art

Conventionally an ignition coil, in which high voltage is generated in a secondary coil by mutual induction effect, is known. An igniter interrupts electric power distribution to a primary coil, which constitutes a part of the ignition coil, to generate the high voltage. Then, the high voltage is applied to a spark plug that is connected to one end of the ignition coil.

The ignition coils are roughly classified into stick coils and rectangular coils. The stick coil has a stick-like shape, and its constituents such as a primary coil, a secondary coil, a central core and the peripheral core are arranged in a cylindrical case that is placed in a plug hole. The rectangular coil has a rectangular shape, and its constituents are arranged in a rectangular box-like housing that is placed above a top opening of the plug hole.

Recently, it is demanded to raise output of ignition coils. In a stick coil, the number of turns (outer diameter) of the primary and secondary coils and an outer diameter of the central core are limited by a bore diameter of the plug hole. In contrast, in a rectangular coil, the number of turns (outer diameter) of the primary and secondary coils and the outer diameter of the central core are not limited by the bore diameter of the plug hole and can be arbitrary determined. Accordingly, the need for rectangular coils has been growing instead of stick coils.

As an implementation of the rectangular coil, JP6-084664A discloses an ignition coil in which a columnar cylindrical central core, a primary coil, a secondary coil and a hollowed rectangular peripheral core are arranged in a housing. The hollowed rectangular peripheral core is opposed to both longitudinal end surfaces of the central core and is also opposed to both radial sides of the central core.

However, compared with a stick coil, in which constituents such as a central core is arranged in a cylindrical member, a rectangular coil, in which constituents such as a central core is arranged in a housing, has a relatively large height of the housing that is placed above an opening of a plug hole. However, it is demanded to reduce the height of the housing of the rectangular coil, that is, to downsize the ignition coil, since there is a necessity to reserve a space behind a hood of a vehicle for the purposes of pedestrian protection etc. In this regard, it is difficult to downsize the ignition coil in basically maintaining the shapes of the constituents such as a central core and a peripheral core, which are necessary for securing the performance of the ignition coil.

SUMMARY OF THE INVENTION

The present invention is made in view of the above-mentioned problem. Thus, it is an objective of the present invention to provide an ignition coil having a relatively small size, by optimizing a layout of constituents such as a central core in the housing without downsizing the constituents.

To achieve the objective of the present invention, there is provided an ignition coil for applying high voltage to a spark plug that is installed at a bottom of a plug hole of an internal combustion engine. The ignition coil has a tube member, a housing, a central core, a primary coil, a secondary coil, a peripheral core, an igniter and a terminal treatment portion. The tube member is adapted to fitting to a top opening of the plug hole. The housing has an approximately rectangular shape and is formed integrally with the tube member so that the housing is located above the top opening of the plug hole when the tube member is fitted to the top opening of the plug hole. The central core has an elongated shape and is installed in the housing so that the central core is in parallel with both side surfaces of the housing. The primary coil is wound around the central core. The secondary coil is wound around the primary coil. The peripheral core has a larger size than the central core in a direction of a height of the housing. The peripheral core includes a first side portion, a second side portion, a third side portion and a fourth side portion. The first side portion and the second side portion are opposed to a first axial end surface and a second axial end surface, respectively, of the central core in an axial direction of the central core. The third side portion and the fourth side portion are placed to interpose the central core, the primary coil and the secondary coil therebetween to magnetically connect the first side portion to the second side portion. The igniter switches on and off electric power supply to the primary coil. The terminal treatment portion is arranged above or below the first side portion to electrically connect the primary coil to an external electric power source. A first center line, which traverses a center of the central core in a longitudinal direction of the central core, is positioned above or below a second center line, which is in parallel with the first center line and traverses a center of the first side portion of the peripheral core.

BRIEF DESCRIPTION OF THE DRAWINGS

The invention, together with additional objectives, features and advantages thereof will be best understood from the following description, the appended claims and the accompanying drawings in which:

DETAILED DESCRIPTION OF PREFERRED EMBODIMENTS

An embodiment of the present invention will be described hereafter with reference to accompanying drawings.

Figure 1A:
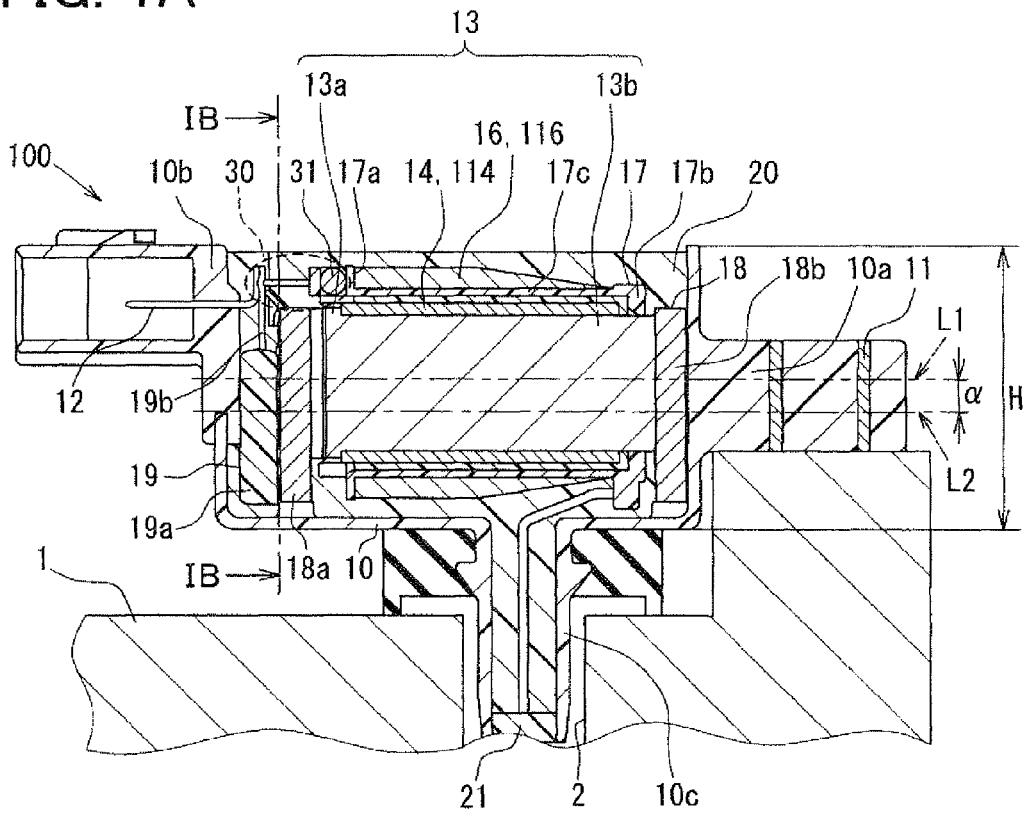
FIG. 1A is a cross-sectional view showing an ignition coil according to an embodiment of the present invention.

FIG. 1A is a cross-sectional view showing a principal part of an ignition coil 100 according to the embodiment of the present invention. A direction from a housing 10 to an engine head 1 along a height of a housing 10 in FIG. 1A is referred to as downward, and the opposite direction is referred to upward in the following description.

As shown in FIG. 1A, in the ignition coil 100, a rectangular box-like housing 10, which opens upward, houses constituents such as a central core 13, a primary coil 14, a secondary coil 16, a secondary spool 17, a peripheral core 18 and the igniter 19. The central core 13 and the peripheral core 18 form a magnetic circuit of the ignition coil 100. The primary coil 14 and the secondary coil 16 generate high voltage in the ignition coil 100 by mutual induction effect. The secondary coil 16 is wound on the secondary spool 17. An electric circuit, which switches timings of high voltage generation in the ignition coil 100 in accordance with signals sent from an external control unit (now shown), is embedded in the igniter 19.

Figure 1B:
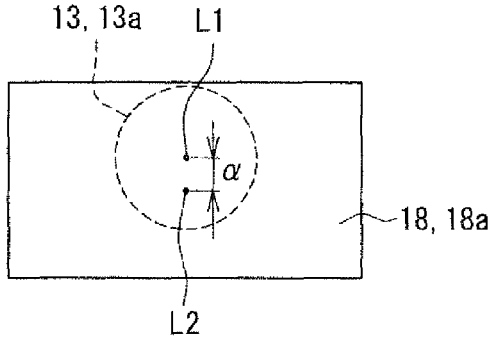
FIG. 1B is a schematic cross-sectional view of the ignition coil, which is taken along a line IB-IB in FIG. 1A.

FIG. 1B is a schematic cross-sectional view of the ignition coil 100, which is taken along a line IB-IB in FIG. 1A. As shown in FIG. 1B, the central core 13 has a cylindrical shape, and is arranged so that its longitudinal direction is perpendicular to the height of the housing 10. The central core 13 includes a flange portion 13*a* and a winder drum portion 13*b*. The flange portion 13*a* prevents a winding of a primary conducting wire 114 of the primary coil 14 from collapsing. The primary coil 14 is wound on the winder drum portion 13*b*. The flange portion 13*a* and the winder drum portion 13*b* are formed by compacting magnetic powder. Specifically, the magnetic powder consists of magnetic metal such as iron, cobalt and nickel, or alloy that mainly includes these metals. Unlike a conventional lamination core, which is formed by laminating electromagnetic steel plates such as silicon steel plates, the central core 13, which is formed by compacting the magnetic powder as mentioned above, has no edge on its outer circumferential surface, and has smooth outer circumferential surface over its entire body.

The primary coil 14 is formed by winding 120 turns of the primary conducting wire 114, which has a diameter of 0.3 to 0.8 mm, on the winder drum portion 13*b* of the central core 13. Compared with a conventional ignition coil, in which a coil is wound on a primary spool that is put on a laminated core, the ignition coil 100 according to this embodiment, in which the primary coil 14 is directly wound on the central core 13, has a relatively small diameter. Accordingly, it is possible to reduce the height of the housing 10 in the ignition coil 100.

The secondary spool 17, which is made of resin and has a cylindrical shape, is put on an outer circumference of the primary coil 14. The secondary spool 17 has flange portions 17*a*, 17*b* at its both axial ends, and a cylindrical portion 17*c* between the flange portions 17*a*, 17*b*. The flange portions 17*a*, 17*b* have larger diameters than the cylindrical portion 17*c*. The flange portions 17*a*, 17*b* are coaxial with the cylindrical portion 17*c*. An inner diameter of the secondary spool 17 is larger than an outer diameter of the central core 13 and than an outer diameter of the primary coil 14. The secondary spool 17 encloses the central core 13 and the primary coil 14 therein.

The secondary coil 16 is wound on the cylindrical portion 17*c* of the secondary spool 17. The secondary coil 16 has a cylindrical shape as a whole. The secondary coil 16 is formed by winding 15000 turns of a secondary conducting wire 116, which has a diameter of 40 to 50 micrometers, on the cylindrical portion 17*c* of the secondary spool 17. It is desirable to use an enamel electric wire as the secondary conducting wire 116, as well as the primary conducting wire 114.

The number of turns of the secondary coil 16 is larger than the number of turns of the primary coil 14. High voltage of 30 to 40 kV is generated in the secondary coil 16 by setting a ratio of the number of turns of the secondary coil 16 to the number of turns of the primary coil 14 at a certain ratio. It is desirable to form the secondary coil 16 by spiral winding in order to avoid dielectric breakdown of the secondary conducting wire 116, which can be caused by inter-layer voltage between two secondary conducting wires 116 in the second coil 16, which are close to each other.

Figure 2:
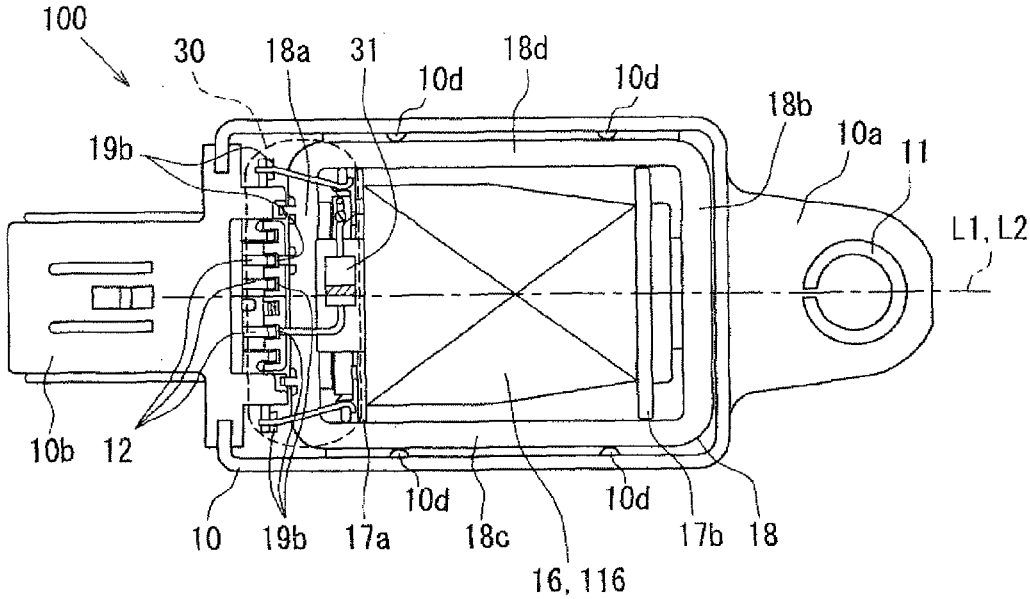
FIG. 2 is a top view of the ignition coil shown in FIG. 1A.

FIG. 2 is a top view showing the ignition coil 100, which is shown in FIG. 1A. The peripheral core 18 shown in FIGS. 1A, 1B, 2 is made of magnetic material such as a silicon steel plate. The peripheral core 18 has a hollowed rectangular shape that opens upward and downward. Specifically, the peripheral core 18 includes a first side portion 18*a*, a second side portion 18*b*, a third side portion 18*c* and a fourth side portion 18*d*, each having a rectangular plate-like shape. The first side portion 18*a* is opposed to the second side portion 18*b*, and the third side portion 18*c* is opposed to the fourth side portion 18*d*. The height of the side portions 18*a*-18*d* is larger than the outer diameter of the central core 13. An air gap is formed between the first side portion 18*a* and one axial end surface of the central core 13, which is opposed to the first side portion 18*a*. The other axial end surface of the central core 13 is in contact with the second side portion 18*b*. As shown in FIG. 2, protruding portions 10*d* are formed on an inner side surface of the housing 10. An outer surface of the third side portion 18*c* and an outer surface of the fourth side portion 18*d* are in contact with the protruding portions 10*d*. An outer surface of the second side portion 18*b* is in contact with the inner side surface of a fastening portion 10*a* side part of the housing 10. Thereby, the peripheral core 18 is positioned in the housing 18.

The igniter 19 is formed by packaging switching devices (not shown) such as IGBTs in molded resin. The igniter 19 includes a box portion 19*a* and pins 19*b*. The box portion 19*a* has a rectangular box-like shape. The pins 19*b* protrude from the box portion 19*a* to electrically connect the box portion 19*a* to an external power source. The igniter 19 is installed in the housing 10 so that the pins 19*b* protrude upward and a direction of thickness of the box portion 19*a* (longitudinal direction of the central core 13 in FIG. 1) is perpendicular to a direction of height of the housing 10.

The housing 10, which houses the central core 13, the primary coil 14, the secondary coil 16, the secondary spool 17, the peripheral core 18 and the igniter 19 therein, is made of resin such as PBT. A potting resin 20 is made of thermosetting resin such as epoxy resin. The housing 10 is placed above an opening of a plug hole 2 that is formed on the engine head 1.

The fastening portion 10*a* is integrally formed on one sidewall of the housing 10. A cylindrical metal bush 11 is embedded in the fastening portion 10*a*. The housing 10 is fastened to the engine head 1 at the fastening portion 10*a* by a bolt (not shown) that is screwed in the metal bush 11. A connector portion 10*b* is formed on the other sidewall of the housing 10, which is opposite from the one sidewall. Terminals 12 for electrically connecting the primary coil 14 to the external power source (not shown) are embedded in the connector portion 10*b*. The terminals 12 include three terminals of a grounding terminal, a control signal terminal and a power terminal. The grounding terminal is for grounding the peripheral core 18. The control signal terminal is for transmitting control signals sent from an external control unit, which controls on and off of the switching device in the igniter 19. The power terminal is connected to an external power source. A terminal treatment portion 30 is provided in the proximity of a connector portion 10*b* side end surface of the flange portion 17*a* of the secondary spool 17. The terminal treatment portion 30 is for electrically connecting the primary coil 14 and the igniter 19 to the external power source through the power terminal. Specifically, in the terminal treatment portion 30, the pins 19*b* of the igniter 19 are connected by arc welding to the terminals 12, which include three terminals of the grounding terminal, the control signal terminal and the power terminal that are respectively bent into L shapes. In the terminal treatment portion 30, a first coil end lead and a second coil end lead of the primary conducting wire 114 are electrically connected to the terminal 12 and the pin 19*b*, respectively.

Furthermore, in the terminal treatment portion 30, the first coil end lead of the primary coil 14 is electrically connected through a diode 31 to a first coil end lead of the secondary coil 16. The diode 16 rectifies current supplied from the external power source not to flow in a direction from the primary coil 14 to the secondary coil 16.

Subsequently, a tube member 10*c* is integrally formed on a bottom wall of the housing 10. Here, the housing 10 and the tube member 10*c* correspond to a casing in the claims. A high-voltage terminal 21 is arranged in the tube member 10*c*. The high voltage terminal 21 is electrically connected to a high-voltage side (winding end) of the secondary coil 16. The high-voltage terminal 21 is electrically connected to a spark plug (not shown) through a conducting spring (not shown). The spark plug is placed below the opening of the plug hole 2. The conducting spring is installed in a tubular case. When the igniter 19, which includes the switching device, interrupts the current that flows from the external power source to the primary coil 14 through the power terminal of the terminals 12, a mutual induction effect between the primary coil 14 and the secondary coil 16 generates high voltage of 30 to 40 kV, for example, in the secondary coil 16. The high voltage generated in the secondary coil 16 in this manner is led to the spark plug through the high-voltage terminal 21, the conducting spring, etc., to generate a spark discharge at a tip end of the spark plug.

The above-described constituents 13, 14, 16-19 of the ignition coil 100 and the terminal treatment portion 30 are arranged in the housing 10. The potting resin 20 such as epoxy resin liquidtightly seals a top opening of the housing 10, and secures electrical insulation between the primary coil 14 and the secondary coil 16.

A layout of the central core 13 and the peripheral core 18 in the housing 10, which is a principal part of the present invention, will be described hereafter with reference to FIGS. 1A, 1B.

Figure 7:
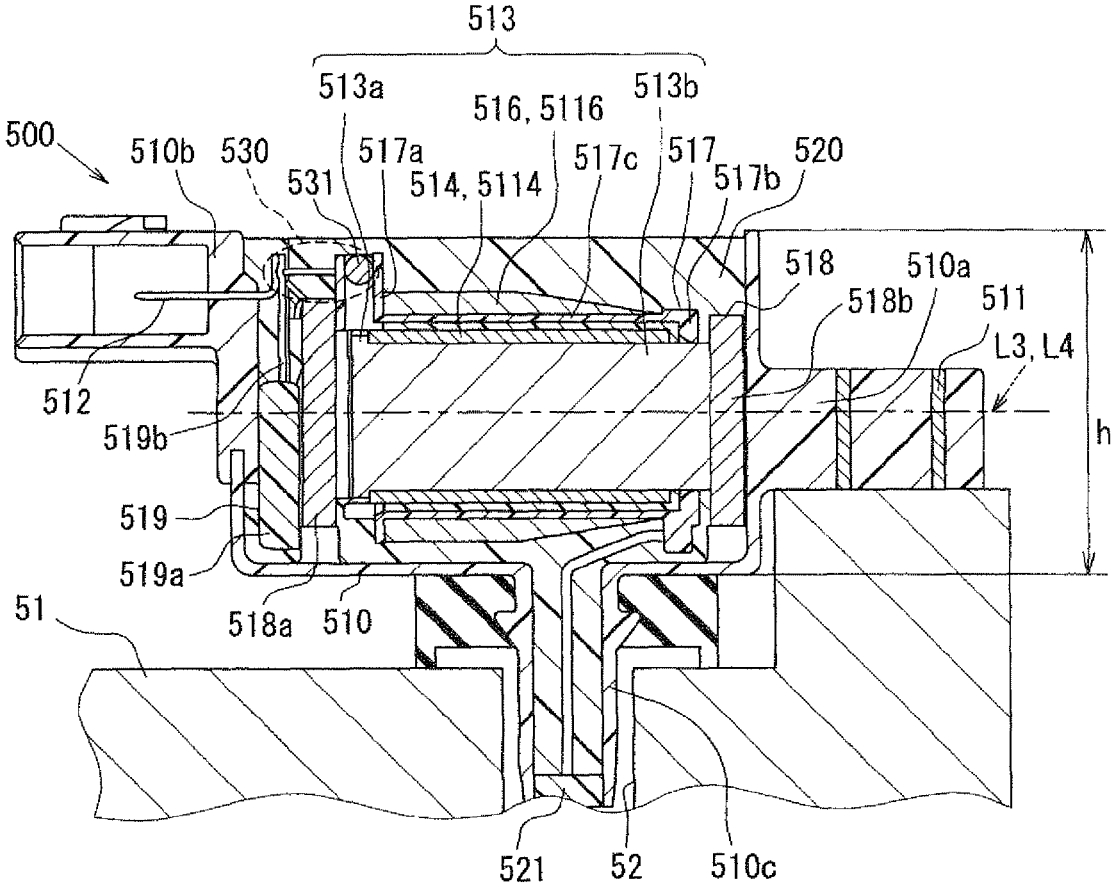
FIG. 7 is a cross-sectional view showing a conventional ignition coil.

With regard to the central core 13 and the peripheral core 18 that are installed in the housing 10, a center line L1 of the central core 13 is positioned above a center line L2 of the peripheral core 18. Here, the center line L1 traverses a center of the central core 13 in its longitudinal direction. The center line L2 extends in parallel with the center line L1, and traverses a middle point of a height of the first side portion 18*a* of the peripheral core 18. A direction of the height of the first side portion 18*a* is perpendicular to the longitudinal direction of the central core 13. That is, the first side portion 18*a* of the peripheral core 18 is offset downward with respect to the central core 13. As shown in FIG. 7, in a conventional ignition coil 500, a center line L3 of a central core is approximately aligned with a center line L4 of a peripheral core L4. Therefore, a height H of the housing 10 of the ignition coil 100 according to the present invention can be smaller than a height h of a housing 510 of the conventional ignition coil 500 by offsetting the terminal treatment portion 30, which is located above the first side portion 18*a*, downward. Accordingly, it is possible to reduce the height H of the housing 10 of the ignition coil 100. Namely, it is possible to downsize the ignition coil 100. The height H of the housing 10 is generally determined in accordance with sizes of the secondary coil 16, the igniter 19, the central core 13, the peripheral core 18 and the terminal treatment portion 30. In this embodiment, assuming that the height of the first side portion 18*a* of the peripheral core 18 is larger than a height of the central core 13, the layout of the peripheral core 18 and the terminal treatment portion 30 is optimized as described above, to downsize the ignition coil 100.

Furthermore, by placing the terminal treatment portion 30 closer to the first side portion 18*a*, it is possible to downsize the housing 10 further.

Furthermore, it is desirable to position the central core 13 and the peripheral core 18 so that a top end surface of the first side portion 18*a* of the peripheral core 18 and a top surface of the flange portion 13*a* of the central core 13 are aligned with each other in the direction of height of the housing 10, that is, on an identical imaginary plane. Thereby, it is possible to downsize the ignition coil 100 to the minimum without inhibiting magnetic performance of a closed magnetic circuit formed of the central core 13 and the peripheral core 18.

In this embodiment, the ignition coil 100 is downsized by setting a distance alpha between the center lines L1, L2, which is measured in the direction of height of the housing 10, at 2.0 mm. However, size and performance of the ignition coil is changed in accordance with vehicle models etc. Accordingly, when the peripheral core 18 has a relatively large thickness and a relatively small height, it is possible to set the distance alpha at 1.0 mm. When the peripheral core 18 has a relatively small thickness and a relatively large height, it is possible to set the distance alpha at 3.0 mm. Namely, it is desirable to set the distance alpha between the center lines L1, L2 at an appropriate length within a range of 1.0 mm to 3.0 mm in accordance with the sizes of the housing 10, the central core 13 and the peripheral core 18, in order to downsize the ignition coil 100. Specifically, in view of variation of parts in manufacture, it is desirable to set the distance alpha including tolerance within the range of 1.0 mm to 3.0 mm.

Next, a desirable mode of the sizes of the central core 13 and the peripheral core 18, which constitute the magnetic circuit of the ignition coil 100 and secure the performance of the ignition coil 100 together with the above-mentioned primary coil 14 and the secondary coil 16, will be described hereafter.

Figure 3:
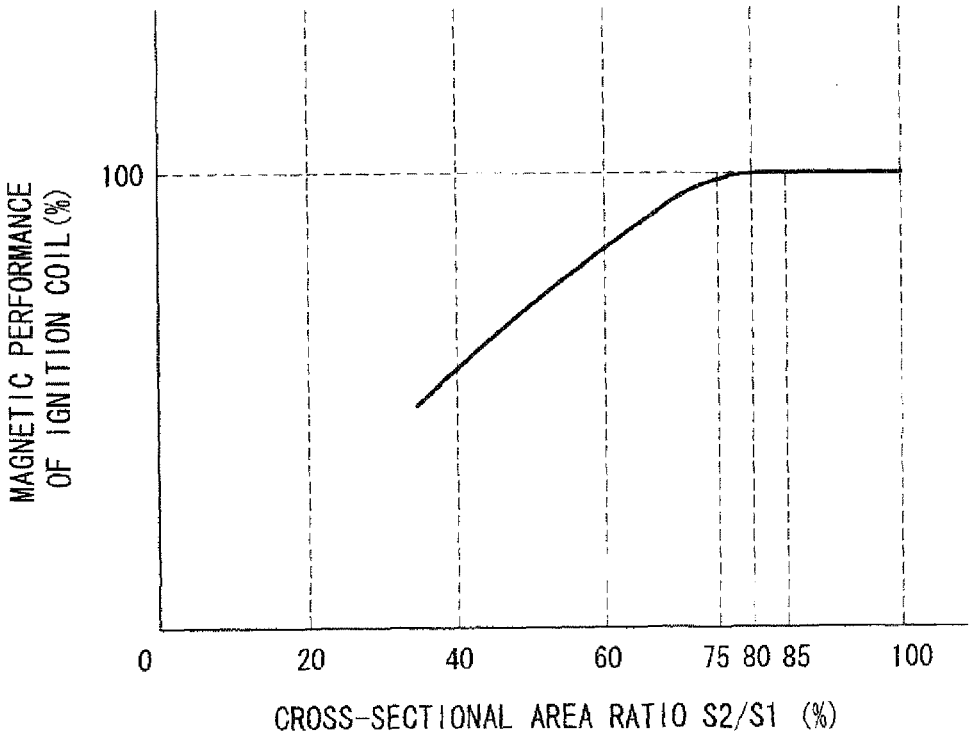
FIG. 3 is a graph showing a magnetic performance of the ignition coil with respect to a cross-sectional area ratio S2/S1.

FIG. 3 is a graph showing the magnetic performance of the ignition coil 100 with respect to cross-sectional areas of the central core 13 and the peripheral core 18. The vertical axis of the graph corresponds to the magnetic performance of the ignition coil 100. The horizontal axis of the graph corresponds to a cross-sectional area ratio S2/S1, in which S2 is a cross-sectional area of the peripheral core 18, and S1 is a cross-sectional area of the winder drum portion 13*b* of the central core 13. The magnetic performance of the ignition coil 100 has a correlation with the voltage generated in the secondary coil 16. The cross-sectional area of the winder drum portion 13*b* corresponds to a cross-sectional area of the central core in the claims.

As shown in FIG. 3, the magnetic performance of the ignition coil 100 rises as the cross-sectional area ratio S2/S1 increases, yet the magnetic performance becomes saturated when the cross-sectional area ratio S2/S1 approximately reaches 75%. That is, energization of the primary coil 14 changes magnetic flux interlinked with the secondary coil 16 at the maximum, by using the cylindrical central core 13 and the hollowed rectangular peripheral core 18, of which the cross-sectional areas satisfy S2/S1≅75%, together with the primary coil 14 and the secondary coil 16 having the above-mentioned number of turns. Thereby, it is possible to generate the high voltage of 30 to 40 kV in the secondary coil 16. In this embodiment, S1 is 134 $mm^2$, S2 is 109 $mm^2$, and S2/S1 is 81%. Here, the cross-sectional area S2 of the peripheral core 18 refers to a sum of cross-sectional areas of the third and fourth side portions 18*c*, 18*d*, which are taken in a direction of their thickness.

If S2/S1 is smaller than 75%, the available magnetic performance is insufficient. If S2/S1 is larger than 85%, the peripheral core 18 is superfluously large and does not efficiently contribute to improvement of the magnetic performance. Therefore, it is desirable to set the cross-sectional area ratio S2/S1 equal to or smaller than 85%. In order to securely obtain sufficient magnetic performance, it is more desirable to set the cross-sectional area ratio S2/S1 between 80% and 85%.

With respect to the primary coil 14 and the secondary coil 16, which are installed in the housing 10 together with the central core 13 and the peripheral core 18, the primary coil 14 is formed by winding 120 turns of the primary conducting wire 114, and the secondary coil 16 is formed by winding 15000 turns of the secondary conducting wire 116 in this embodiment. However, size and performance of the ignition coil is changed in accordance with vehicle models etc. Accordingly, the number of turns of the primary coil 14 and the number of turns of the secondary coil 16 are changed as needed in accordance with vehicle models etc. Therefore, in addition to the above-described mode of this embodiment, the cross-sectional areas S1, S2 may be modified on a condition that S2/S1 is between 75% and 85%, in order to adapt the ignition coil 100 according to this embodiment to various engines. Moreover, the primary coil 14 may be formed by winding 110 to 230 turns of the primary conducting wire 114, and the secondary coil 16 may be formed by winding 10000 to 20000 turns of the secondary conducting wire 116, provided a condition that a certain ignition performance can be obtained.

Other Embodiments

One embodiment of the present invention is described above. However, the present invention is not limited only to the mode of the above-described embodiment. The present invention may be applied to varied embodiments in accordance with its spirit.

Figure 4:
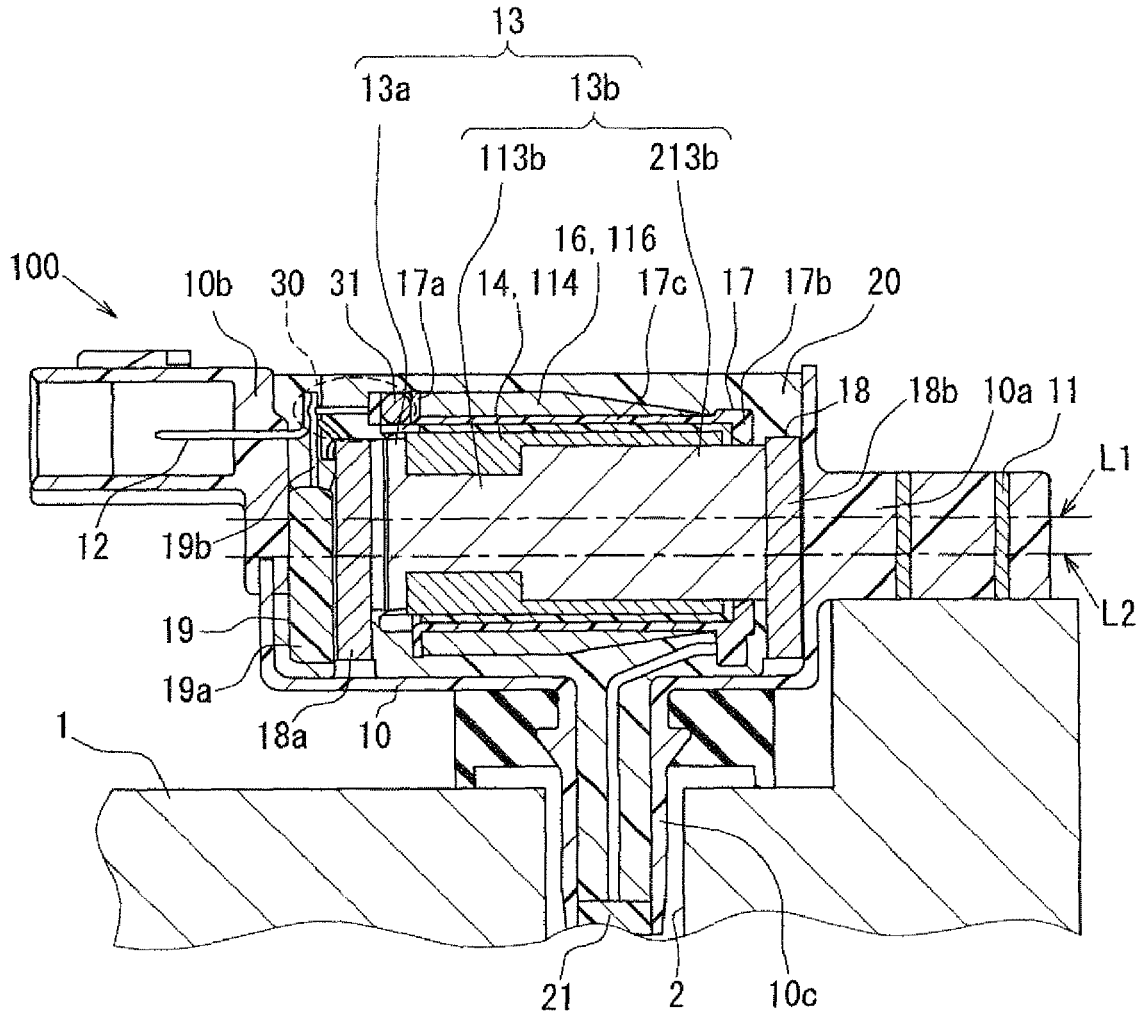
FIG. 4 is a cross-sectional view showing an ignition coil according to a modification of the embodiment shown in FIG. 1A.

For example, as shown in FIG. 4, the winder drum portion 13*b* of the central core 13 may include a first winder drum portion 113*b*, which has a relatively small diameter, and a second winder drum portion 213*b*, which has a relatively large diameter. The first and second winder drum portions 113*b*, 213*b* are arranged along an axial direction of the central core 13. In this case, the cross-sectional area S1 of the winder drum portion 13*b* of the central core 13 is calculated as below. In such a central core 13 that has winder drum portions 113*b*, 213*b* of which diameters differ from each other, an imaginary winder drum portion, which has a uniform diameter, is assumed. A cross sectional area of this imaginary winder drum portion is regarded as the cross-sectional area S1 of the winder drum portion 13*b*. Specifically, a volume V11 of the first winder drum portion 113*b* is calculated by taking an integral of a cross-sectional area of the first winder drum portion 113*b* with respect to a length of the first winder drum portion. Here, the cross-sectional area of the first winder drum portion 113*b* is measured in a radial direction of the central core 13. A volume V12 of the second winder drum portion 213*b* is calculated in an analogous fashion. The cross-sectional area S1 of the above-mentioned imaginary winder drum portion is calculated by dividing (V11+V12) by an overall length of the winder drum portion 13*b*. For example, when the volume V11 of the first winder drum portion 113*b* is 1440 $mm^3$, the volume V12 of the second winder drum portion 213*b* is 3760 $mm^3$, and the overall length of the first and second winder drum portions 113*b*, 213*b* is 40 mm, the cross-sectional area S1 of the imaginary winder drum portion is 130 $mm^2$. As described above, the cross-sectional area S1 of the winder drum portion 13*b* of the central core 13 is uniquely defined. Therefore, the cross-sectional area ratio S2/S1 in the present invention can be regarded as a universal value.

Figure 5:
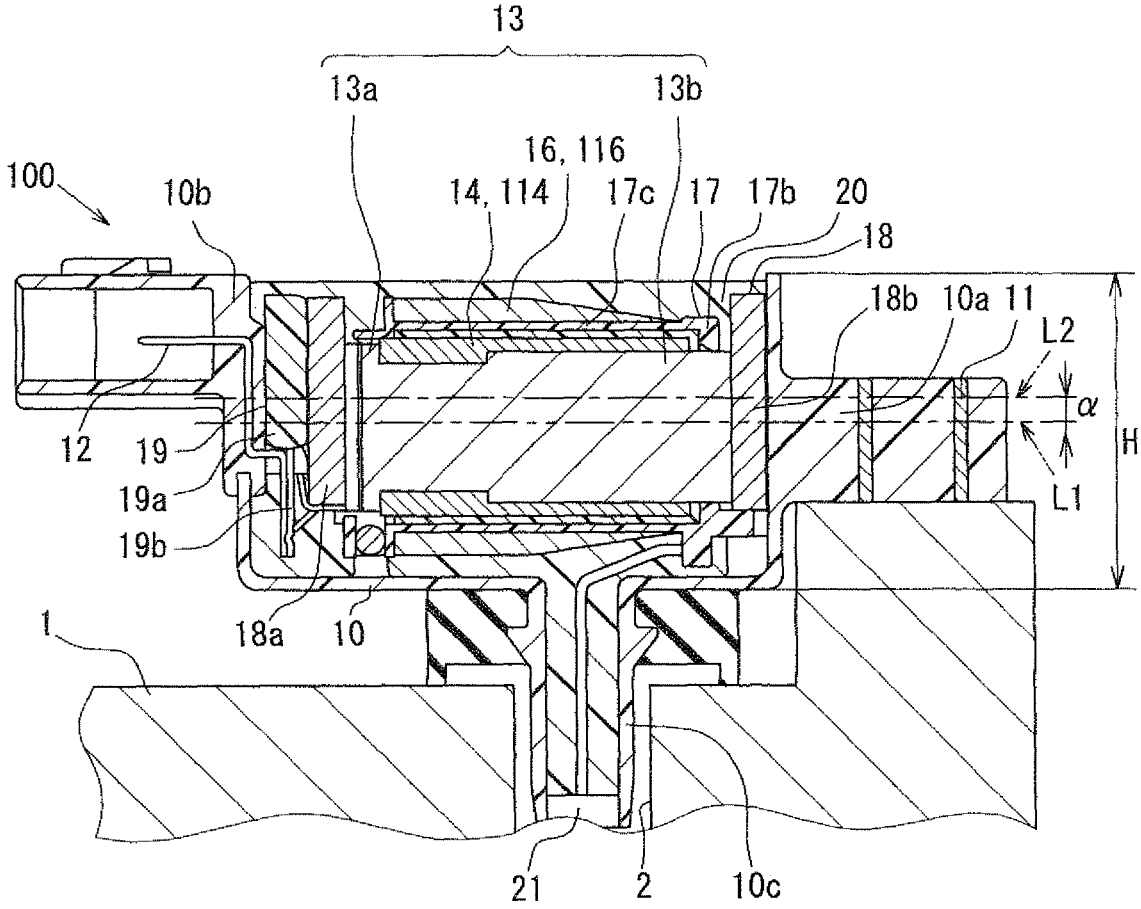
FIG. 5 is a cross-sectional view showing an ignition coil according to another modification of the embodiment shown in FIG. 1A.

In the above-described embodiment, the central core 13 and the peripheral core 18 are arranged so that the center line L2 of the peripheral core 18 is offset downward with respect to the center line L1 of the central core 13, and the terminal treatment portion 30 is located above the first side portion 18*a* of the peripheral core 18. Alternatively, as shown in FIG. 5, it is also possible to offset the center line L2 of the peripheral core 18 upward with respect to the center line L1 of the central core 13. The connector portion 10*b* and the terminals 12 are positioned at an upper part of the housing 10. However, the connector portion 10*b* may be located at a lower part of the housing 10 to reduce lengths of the terminals 12.

Figure 6:
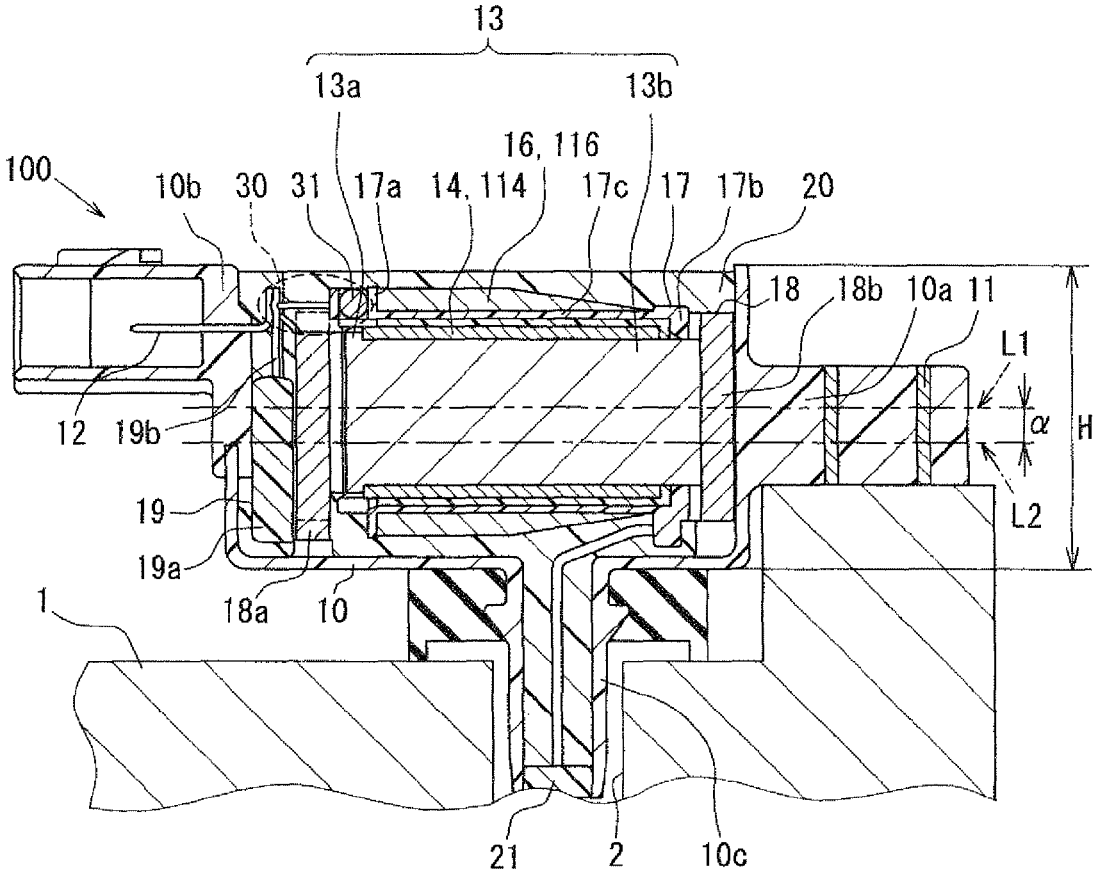
FIG. 6 is a cross-sectional view showing an ignition coil according to still another modification of the embodiment shown in FIG. 1A.

Moreover, as shown in FIG. 6, it is also possible to offset only the first side portion 18*b* downward among the first to four side portions 18*a*-18*d*, which constitute the peripheral core 18. Similarly, it is also possible to provide a notch on the top end surface of the first side portion 18*a* to arrange the terminal treatment portion 30 in this notch. Thereby, it is possible to downsize ignition coil 100.

In the above-described embodiment, the potting resin 20 is filled in the housing 10 to form the ignition coil 100. Alternatively, it is also possible to provide the constituents 13, 14, 16-19, 30, etc. as an assembly and to insert this assembly in a body of the ignition coil 100 by insert molding to form the ignition coil 100.

Additional advantages and modifications will readily occur to those skilled in the art. The invention in its broader terms is therefore not limited to the specific details, representative apparatus, and illustrative examples shown and described.

What is claimed is:

1. An ignition coil for applying high voltage to a spark plug that is installed at a bottom of a plug hole of an internal combustion engine, comprising:

a tube member adapted to fitting to a top opening of the plug hole;

a housing that has an approximately rectangular shape and is formed integrally with the tube member so that the housing is located above the top opening of the plug hole when the tube member is fitted to the top opening of the plug hole;

a central core that has an elongated shape and is installed in the housing so that the central core is in parallel with both side surfaces of the housing;

a primary coil that is wound around the central core;

a secondary coil that is wound around the primary coil;

a peripheral core that has a larger size than the central core in a direction of a height of the housing and includes:

a first side portion and a second side portion that are opposed to a first axial end surface and a second axial end surface, respectively, of the central core in an axial direction of the central core; and a third side portion and a fourth side portion that are placed to interpose the central core, the primary coil and the secondary coil therebetween to magnetically connect the first side portion to the second side portion;

an igniter that switches on and off electric power supply to the primary coil; and a terminal treatment portion that is arranged above or below the first side portion to electrically connect the primary coil to an external electric power source, wherein a first center line, which traverses a center of the central core in a longitudinal direction of the central core, is positioned above or below a second center line, which is in parallel with the first center line and traverses a center of the first side portion of the peripheral core.

2. The ignition coil according to claim 1, wherein the terminal treatment portion is positioned in a proximity of the first side portion.

3. The ignition coil according to claim 1, wherein a top surface of the flange portion of the central core and a top end surface of the first side portion of the peripheral core are aligned on an identical imaginary plane that is perpendicular to the height of the housing.

4. The ignition coil according to claim 1, wherein a distance between the first center line and the second center line, which is measured along the height of the housing, is between 1.0 mm and 3.0 mm.

5. The ignition coil according to claim 1, wherein the height of the housing is between 40 mm and 60 mm.

6. The ignition coil according to claim 1, wherein a sum of cross-sectional areas of the third side portion and the fourth side portion, which are measured perpendicularly to the axial direction of the central core, is between 75% and 85% of a cross-sectional area of the central core, which is measured perpendicularly to the axial direction of the central core.

7. The ignition coil according to claim 1, wherein the primary coil and the secondary coil are configured so that a voltage between 30 kV and 40 kV is generated in the secondary coil when the igniter switches off the electric power supply to the primary coil.

* * * * *